United States Patent [19]

Villanueva et al.

[11] 4,170,286

[45] Oct. 9, 1979

[54] APPARATUS FOR DEFIBERING SHEATHS OF FIBROUS MATERIAL, PARTICULARLY SHEATHS OF ABACA

[76] Inventors: Juan T. Villanueva; Jesus T. Villanueva, both of 105 Apo St., Quezon City, Philippines

[21] Appl. No.: 605,327

[22] Filed: Aug. 18, 1975

Related U.S. Application Data

[60] Division of Ser. No. 543,620, Jan. 23, 1975, which is a continuation-in-part of Ser. No. 258,875, Jun. 1, 1972, Pat. No. 3,887,063, which is a continuation-in-part of Ser. No. 830,449, Jan. 4, 1969, Pat. No. 3,670,366.

[30] Foreign Application Priority Data

Jun. 4, 1968 [PH] Philippines ..... 9282

[51] Int. Cl.[2] ..... B65G 35/00

[52] U.S. Cl. ..... 198/628; 198/605; 198/817

[58] Field of Search ..... 198/165, 190, 193, 626, 198/627, 628, 604, 605, 817; 19/12

[56] References Cited

U.S. PATENT DOCUMENTS

| | | | |
|---|---|---|---|
| 509,314 | 11/1893 | Keene | 198/190 |
| 2,928,525 | 3/1960 | Schaeffer | 198/165 |
| 3,485,707 | 12/1969 | Spicer | 198/193 X |

FOREIGN PATENT DOCUMENTS

| | | | |
|---|---|---|---|
| 442059 | 1/1936 | United Kingdom | 198/165 |
| 866208 | 4/1961 | United Kingdom | 198/817 |

*Primary Examiner*—Evon C. Blunk
*Assistant Examiner*—Douglas D. Watts
*Attorney, Agent, or Firm*—Michael J. Striker

[57] ABSTRACT

First and second endless conveyor arrangements respectively comprise a first and a second endless conveyor having a first and a second run. The second run adjoins the first run, and they together define an elongated path for fibrous material which is to be transported gripped between the runs. The first elongated endless conveyor comprises a plurality of parallel endless first elongated conveyor sections arranged side-by-side to define a plurality of elongated parallel first intermediate spaces extending along substantially the entire length of the first run. The second conveyor is similarly constructed so as to define similar second intermediate spaces. Along substantially the entire lengths of the first and second runs, the aforementioned sections of the conveyors project in direction from the respective run towards the other run into respective ones of the intermediate spaces of the other conveyor. The first and second conveyors are respectively comprised of a first and a second plurality of parallel spaced discrete endless conveyor members each constituting one of the first or second sections, respectively.

10 Claims, 14 Drawing Figures

FIG. 3
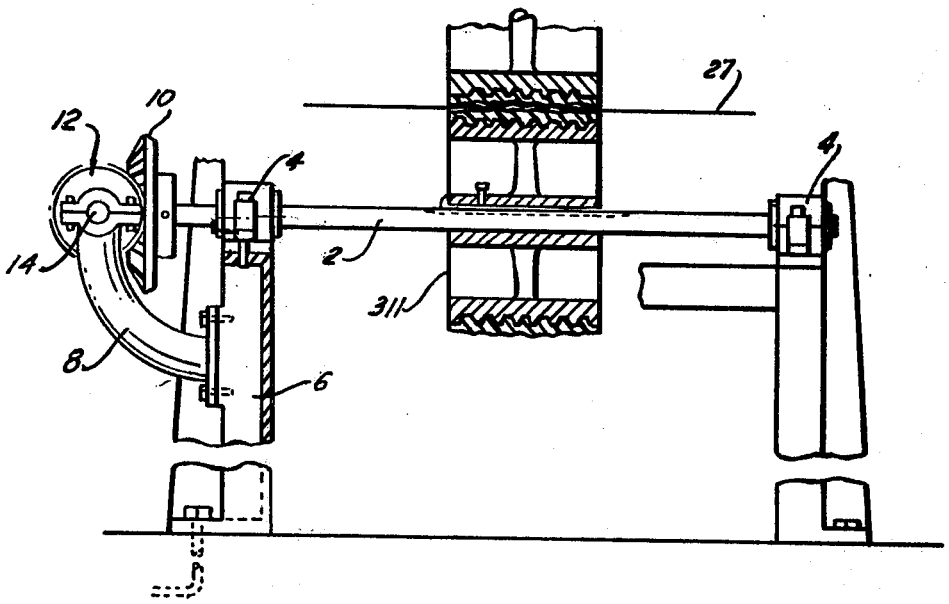
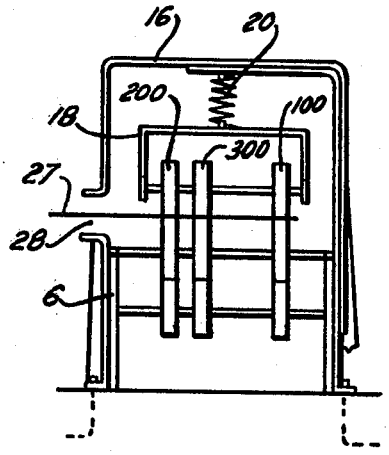
FIG. 4

APPARATUS FOR DEFIBERING SHEATHS OF FIBROUS MATERIAL, PARTICULARLY SHEATHS OF ABACA

CROSS-REFERENCES TO RELATED APPLICATIONS

The present application is a division of prior copending application Ser. No. 543,620 filed Jan. 23, 1975. Application Ser. No. 543,620 was a continuation-in-part of allowed copending application Ser. No. 258,875, filed June 1, 1972. Application Ser. No. 258,875 now U.S. Pat. No. 3,887,063 in turn, was a continuation-in-part of application Ser. No. 830,449 filed Jan. 4, 1969 and now U.S. Pat. No. 3,670,366.

BACKGROUND OF THE INVENTION

This invention relates to a conveyor arrangement which for purposes of explanation is illustrated and described as finding use in an apparatus for stripping "leaf sheaths" or "tuxies" as they are more commonly known from Manila Hemp Plant, also known as Abaca.

While sheaths of fibrous material, such as Abaca, have in former times been stripped by hand by pulling each leaf sheath between stripping elements comprising a blade and a wooden block, an apparatus for automatically stripping sheaths of fibrous material has been disclosed in our above-mentioned U.S. Pat. No. 3,690,366. The aforementioned patent discloses an apparatus for defibering sheaths of fibrous material, particularly Manila hemp, by conveying the sheaths past several stationary blades arranged in the path of travel of the sheaths whereby the edges of the blades separate the fibrous part of the sheaths from the pulpy parts. However, in operation of this apparatus certain difficulties did arise in that the sheaths to be defibered did slip with regard to the transporting means used for transporting the sheaths past the stationary blades.

SUMMARY OF THE INVENTION

It is an object of the present invention to provide a conveying arrangement which can be used in an apparatus for automatically defibering sheaths of fibrous material, which avoids the difficulties encountered with apparatus of this type.

It is further object of the present invention to provide improved conveying means which will positively grip the sheaths to be defibered so that slippage of these sheaths with regard to the conveying means may be avoided.

It is an additional object of the present invention to provide an apparatus of the aforementioned kind which is composed of relatively few and rugged parts, so that the apparatus may be built at reasonable cost and function perfectly even after extended use.

With these and other objects in view, which will become apparent as the description proceeds, the conveyor for use in an apparatus for defibering sheaths of fibrous material, particularly sheaths of Abaca, mainly comprises an upper and a lower endless conveyor having adjacent runs for positively engaging opposite surface portions of the sheaths therebetween for transporting successive sheaths sideways along a predetermined path. The upper endless conveyor of the conveyor means comprises a plurality of pulleys each formed with a plurality of circumferential grooves and being mounted spaced from each other in the direction of the aforementioned path for rotation about parallel axes substantially normal to the path and an endless flexible means located in the grooves of said pulleys. The lower endless conveyor of the conveyor means comprises along its upper run a plurality of pulleys each formed with a plurality of circumferential grooves which are offset in the direction normal to the path with respect to the grooves in the pulley of the upper conveyor. The pulleys of the lower conveyor are mounted for rotation about parallel axes substantially normal to said path, which axes are spaced from each other in the direction of the path but offset in this direction with respect to the axes of the pulleys of the upper conveyor coordinated therewith, and endless flexible means located in the grooves of the pulleys in the lower conveyor. The apparatus comprises further drive means for driving at least one pulley of each conveyor.

The apparatus preferably further includes first stationary support means mounting the pulleys of the lower endless conveyor means for rotation about their axes, second support means movable substantially in vertical direction toward and away from the stationary support means and mounting the pulleys of the upper endless conveyor of each conveyor means for rotation about their axes and biasing means biasing said movable support means toward the stationary support means.

The aforementioned grooves in the pulleys may have a cross-section forming part of a circle and the grooves may be separated by ridges each having a cross-section of a convex circular sector. In this case the endless flexible means located in the grooves may have circular cross sections and may be constituted by ropes.

On the other hand, and preferably, each of the grooves in the pulleys may have a trapezoidal cross-section in which case the endless flexible means comprises an endless band having a plurality of longitudinally extending transversely spaced ridges of corresponding trapezoidal cross-section projecting from one face of the band and being respectively located in the groove, whereas the other face of the band has an undulated surface which will engage the sheaths of fibrous material to be transported.

The undulations of the band of the upper conveyor of each conveyor means are preferably transversely offset with respect to the undulations of the band of the lower conveyor of the respective conveyor means.

The band is preferably formed from rubber, and it preferably includes also reinforcements embedded in the rubber.

The novel features which are considered as characteristic of the invention are set forth in particular in the appended claims. The invention itself, however, both as to its construction and its mode of operation, together with additional features and advantages thereof, will be best understood upon perusal of the following detailed description of certain specific embodiment with reference to the accompanying drawing.

BRIEF DESCRIPTION OF THE DRAWING

FIG. 3 is a partial cross section taken along the line III—III of FIG. 1 and drawn to an enlarged scale;

FIG. 4 is a schematic cross section taken along the line IV—IV of FIG. 1;

FIGS. 5A–7B are presented to show each of the three conveyor means separately so that the arrangement of each of the conveyor means may be clearly ascertained whereby for clarity's sake the upper conveyor of each conveyor means is shown spaced upwardly from the lower conveyor thereof;

DESCRIPTION OF THE PREFERRED EMBODIMENTS

Figure 1:
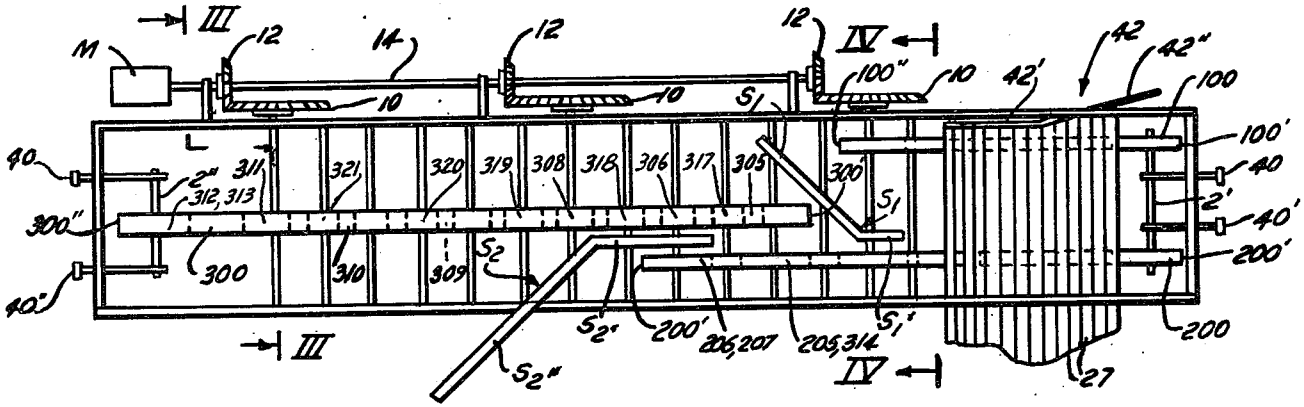
FIG. 1 is a schematic top view of the conveyor apparatus according to the present invention employed in a defibering machine.
Figure 2:
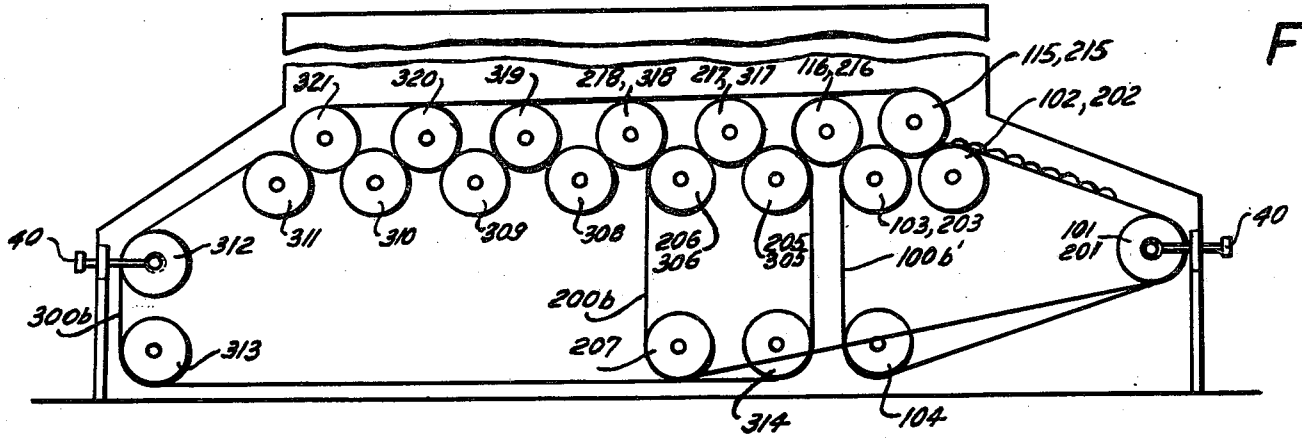
FIG. 2 is a schematic side view of the apparatus.

For purposes of explanation, several conveyor arrangements according to the present invention are shown employed in a machine for defibering fibrous material, particularly abaca. Referring now to the drawing and more specifically to FIGS. 1 and 2 of the same, it will be seen that the apparatus may comprise a plurality of conveyor means for transporting sheaths of fibrous material 27, for instance Abaca, sideways along a rectilinear path extending in the direction of the conveyor means. The conveyor means comprise a first conveyor means 100, a second conveyor means 200 extending parallel and transversely spaced from the first conveyor means. The conveyor means 100 has a leading end 100′ which is preferably aligned with the leading end 200′ of the second conveyor means 200 in direction transverse to the longitudinal direction of the two conveyor means, whereas the trailing end 200″ of the second conveyor means is located downstream, and spaced a considerable distance from the trailing end 100″ of the first conveyor means. A third conveyor means 300 extends parallel and inwardly spaced from the first and the second conveyor means and this third conveyor means has a leading end 300′ spaced transversely from and downstream of the trailing end 100″ of the first conveyor means to define between the trailing end 100″ of the first conveyor means and the leading end 300′ of the third conveyor means a gap G. As further seen in FIG. 1, the trailing end 300″ of the third conveyor means is located downstream and spaced a considerable distance from the trailing end 200″ of the second conveyor means, because of the lengths of the abaca tuxies or leaf sheaths and fibers resulting therefrom. The apparatus includes further two stationary stripping means $S_1$ and $S_2$ each of which includes an upright stripping blade having an upper edge, and the stripping means $S_1$ has a first short roundedged portion $S'_1$ extending between and parallel to the first and second conveyor means 100 and 200 and closer to the conveyor means 200 than to the conveyor means 100, and a second portion $S''_1$ with the well defined sharp corners of its square shaped dull edge extending at an obtuse angle from the portion $S'_1$ through the aforementioned gap G slightly beyond the first conveyor means 100. The second stripping means $S_2$ likewise comprises a first round edged portion $S'_2$ extending parallel to and between the second and third conveyor means 200 and 300, whereas a second portion $S''_2$ of the second stripping means with the well defined sharp corners of its square shaped dull edge extends at an obtuse angle to the first portion away from the third conveyor means 300, downstream and adjacent to the trailing end 200″ of the second conveyor means 200, and laterally beyond the latter. The specific construction of the stripping means $S_1$ and $S_2$ does not form part of the present invention and this construction is clearly disclosed in U.S. Pat. No. 3,670,366. As described therein, each of the stripping means may also comprise a wooden block for pressing the sheaths while being transported by the transporting means against the upper stripping edge of the blades of the stripping means.

Each of the conveyor means 100–300 comprise an upper conveyor and a lower conveyor cooperating therewith to grip the sheaths of fibrous material between the lower run of the upper conveyor and the upper run of the lower conveyor. While the upper and lower conveyors of the three conveyor means are shown in FIG. 2 in their position relative to each other, FIGS. 5A–7B respectively show only the first, the second or the third conveyor in full lines while indicating respectively the other conveyors in dotted lines, so that the arrangement of each of these conveyors may be better visualized.

Figure 5A:
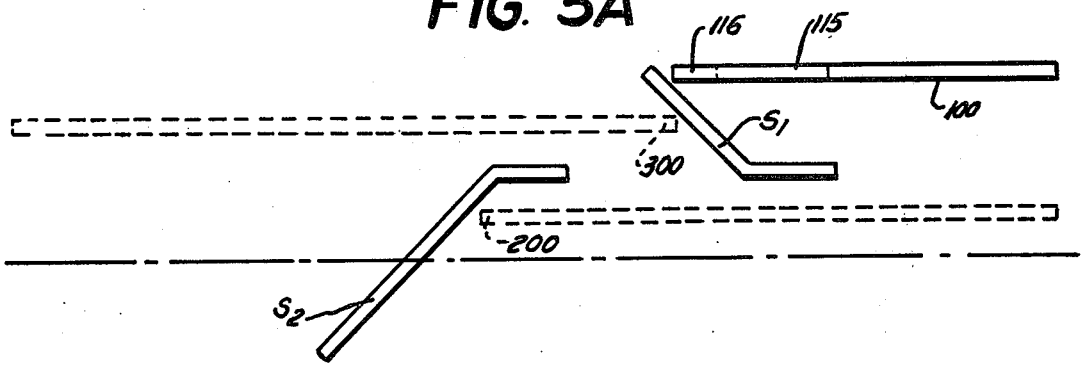
FIGS. 5A and 5B respectively show the first conveyor in top view and side view in full lines and its relation to the stripping blade.
Figure 5B:
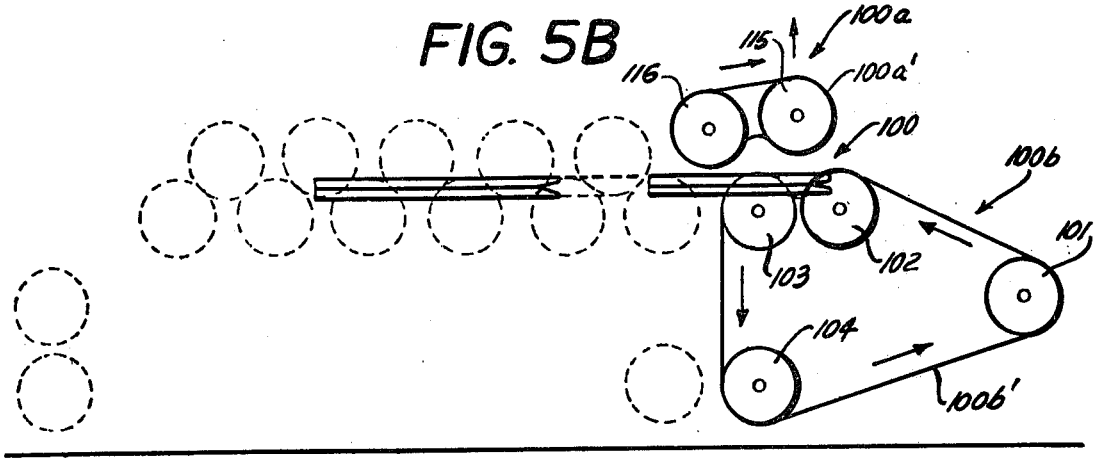

Referring now to the FIGS. 5A and 5B it will be seen that the first conveyor means 100 comprises an upper conveyor 100*a*, and a lower conveyor 100*b*. The upper conveyor 100*a* comprises two pulleys 115 and 116 rotatable about parallel axes extending normal to the longitudinal direction of the conveyor and an endless flexible means 100*a*′ which will be described in detail later on, extending about the periphery of the two pulleys 115 and 116. The lower conveyor 100*b* of the first conveyor means 100 comprises two pulleys 102 and 103 respectively cooperating with the pulleys 115 and 116 of the upper conveyor 100*a* in a manner as will be described later on and two additional pulleys 101 and 104 arranged downwardly of the pulleys 102 and 103 with the pulley 101 arranged also upstream of the pulley 102. An endless flexible means 100*b*′ extends around the pulleys 101–104 as shown in FIG. 5B. As likewise shown in this Figure, the axes of the pulleys 102 and 103 are offset with respect to the axes of the pulleys 115 and 116, in longitudinal direction of the conveyor and while in FIG. 5B the upper conveyor 100*a* is for clarity's sake shown upwardly spaced from the lower conveyor 100*b*, in actuality, the pulleys 115 and 116 of the upper conveyor 100*a* are arranged with regard to the pulleys 102 and 103 of the lower conveyor 100*b* as shown in FIG. 2 so that the vertical distance of the axes of the pulleys 115 and 116, from the cooperating pulleys 102 and 103 of the lower conveyor 100*b* is smaller than the diameter of the pulleys and so that the endless flexible means 100*a*′ of the upper conveyor flexes upwardly between the pulleys 115 and 116, while the endless flexible means 100*b*′ of the lower conveyor flexes downwardly between the pulleys 102 and 103, as indicated in FIG. 5B, while gripping the sheaths 27 located therebetween.

Figure 6A:
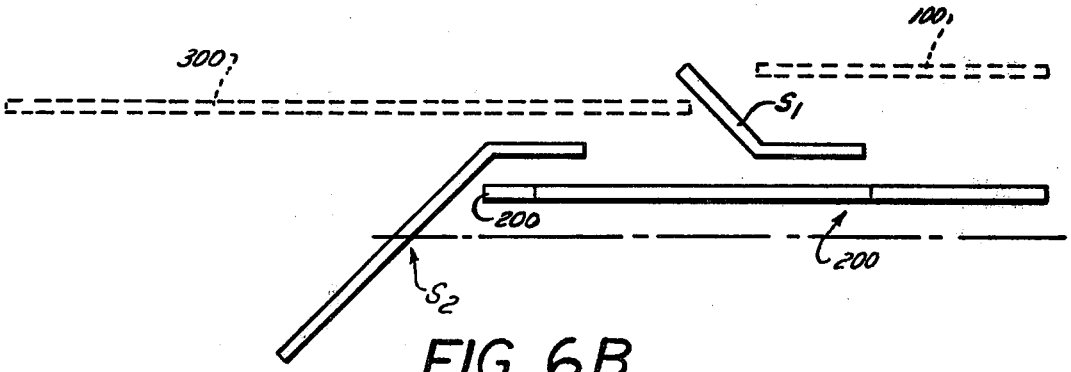
FIGS. 6A and 6B respectively show a top view and a side view of the second conveyor.
Figure 6B:
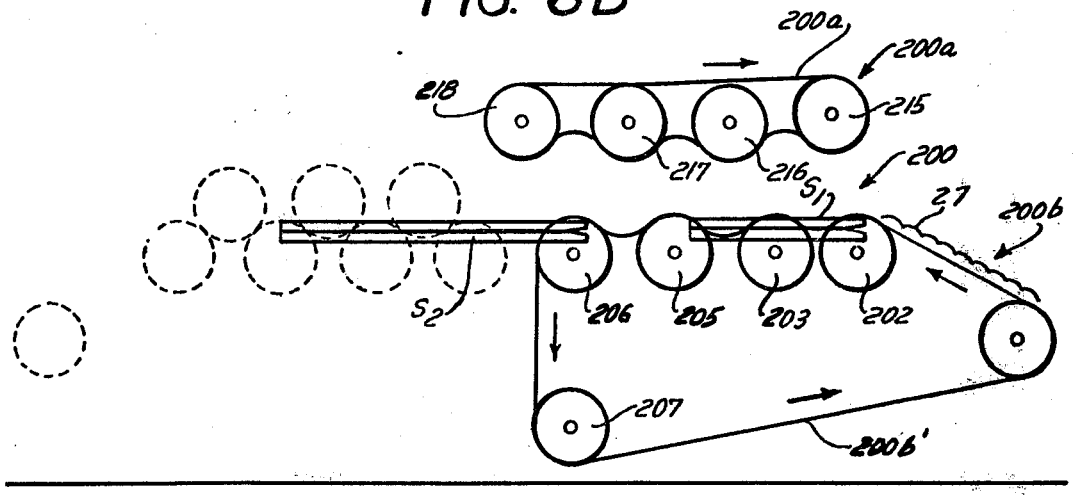

Referring now to FIGS. 6A and 6B in which the second conveyor means 200 and the two stripping means $S_1$ and $S_2$ are shown in full lines, whereas the first conveyor means 100 and the third conveyor 300 are only indicated in dotted lines, it will be seen that the second conveyor means 200 likewise comprises an upper conveyor 200*a* and a lower conveyor 200*b*. The upper conveyor 200*a* comprises four pulleys 215, 216, 217 and 218, the axes of which are located in a horizontal plane and spaced from each other in the longitudinal direction of the conveyor means 200 and an endless flexible means 200*a'* extends about the pulleys 215 and 218 and engages also circumferential portions of the pulleys 216 and 217. The lower conveyor 200*b* comprises six pulleys 201–207, in which the axes of the pulleys 202 to 206 are located spaced in the longitudinal direction of the conveyor means from each other in a horizontal plane and respectively offset in the longitudinal direction of the conveyor means with regard to the axes of the pulleys 215–218. The axis of the pulley 201 is located upstream of the axis of the pulley 202 and at an elevation lower than the axis of the latter, whereas the axis of the pulley 207 is preferably located downwardly spaced from axis of the pulley 206. An endless flexible means 200*b'*, of a nature as will be described later on, extends about the pulleys 201–207. In FIG. 6*b* the upper conveyor 200*a* is for clarity's sake again shown upwardly spaced from the lower conveyor 200*b*, but these conveyors are in actuality arranged with respect to each other as shown in FIG. 2, so that the endless flexible means 200*a'* of the upper conveyor curves upwardly between each of the adjacent pulleys of the upper conveyor whereas the endless flexible means 200*b'* curves downwardly between the adjacent pulleys 202–206, as shown in FIG. 6.

Figure 7A:
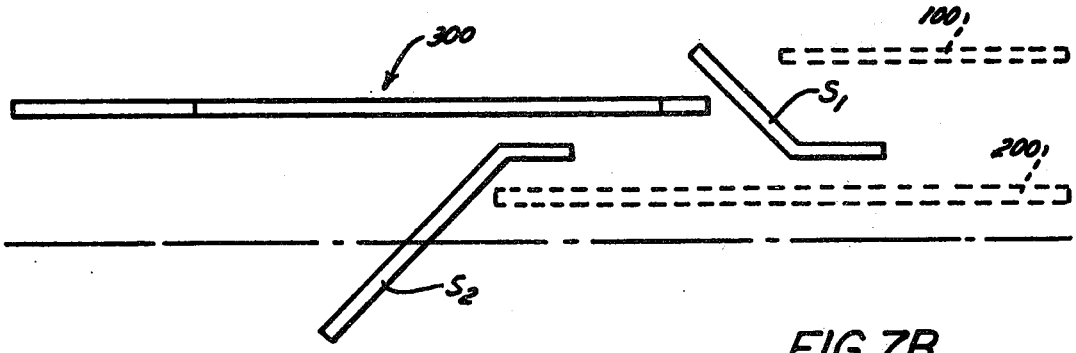
FIGS. 7A and 7B respectively show a top view and side view of the third conveyor.
Figure 7B:
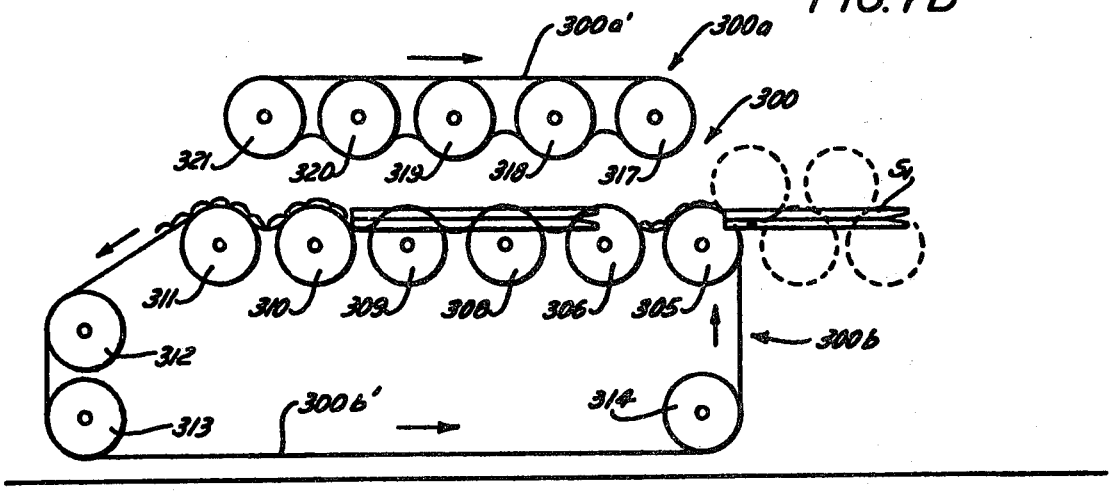

The third conveyor 300 is best shown in FIGS. 7A–7B. As shown in FIG. 7B the upper conveyor 300*a* comprises five pulleys 317–321, the axes of which are located spaced in the longitudinal direction of the conveyor from each other in a horizontal plane and an endless flexible means 300*a'* wound about these pulleys as shown in FIG. 7B. The lower conveyor 300*b* comprises the pulleys 305–314 in which the axes of the pulleys 305–311 are located in a horizontal plane, spaced from each other in the longitudinal direction of the conveyor and offset in this direction with regard to the axes of the pulleys 317–321 of the upper conveyor 300*a*. An endless flexible means 300*b'* is wound about the pulleys of the lower conveyor 300*b*, and again the upper conveyor is shown in FIG. 7B spaced from the lower conveyor, whereas in operation the pulleys of the upper and lower conveyor are arranged with respect to each other as shown in FIG. 2, so that the endless flexible means 300*a'* of the upper conveyor curves upwardly between adjacent pulleys and the endless flexible means 300*b'* of the lower conveyor curves downwardly between the adjacent pulleys 305–311, as indicated in FIG. 7B.

The pulleys of all lower conveyors are mounted on shafts 2 for turning therewith, as shown in the FIG. 3 for the pulley 311, and the shafts 2 are turnably mounted in bearings 4 supported by a stationary frame 6. At least one pulley of each lower conveyor is driven, and as shown in FIGS. 1 and 2, the pulley 103 of the lower conveyor 100*b* and the pulley 203 of the lower conveyor 200*b* are mounted on a common shaft, to the outer end of which, extending beyond the frame 6, a bevel gear 10 is fixed which meshes with a bevel pinion 12 fixedly mounted on a shaft 14, which in turn is driven from a combined power supply source consisting of a speed reducer directly connected to either a driving electric motor M or a mechanical prime mover. The shaft 14 is turnably supported on a plurality of bearings mounted on brackets 8 extending laterally from the frame 6 and fixed thereto by screws or the like as best shown in FIG. 3. Preferably, two of the pulleys of the third conveyor 300*a* are driven, and as shown in FIG. 1, the shafts of the pulleys 308 and 311 are likewise provided at the outer ends thereof with bevel gears 10 fixed thereto which mesh with corresponding bevel pinions 12 on the driving shaft 14.

While the pulleys of all lower conveyors are mounted on the stationary frame 6 anchored to the foundation of the apparatus as indicated in FIG. 3, the pulleys of all upper conveyors are mounted for movement towards and away from the pulleys of the lower conveyors as schematically illustrated in FIG. 4. For this purpose a substantially U-shaped outer frame 16 is connected at one side thereof to the lower frame 6, extending upwardly therefrom, and an inner U-shaped frame 18 supports the shafts of the pulleys of the upper conveyors turnably in bearings respectively mounted on the ends of the legs of the inner U-shaped frame 18. A plurality of springs 20, only one of which is shown in FIG. 4, sandwiched between the outer frame 16 and the inner frame 18, as shown in FIG. 4, presses the inner frame 18 and the pulleys on all upper conveyors downwardly towards the pulleys of all lower conveyors. The outer frame 16 provides on one side thereof an elongated slot 28 through which ends of the fibrous sheaths 27 transported by the conveyors, may extend, as indicated in FIG. 4. Instead of a single inner frame 18, a plurality of such frames may be provided so that the pulleys carried thereby may adjust their position relative to each other.

As shown in FIGS. 1 and 2, the pulleys 101 and 201 are mounted on a common shaft 2' the outer ends of which are not mounted in bearings on the frame 6 but in a pair of tensioning means 40 adjustably mounted in a known manner, not shown in the drawing, in transverse portions of the frame 6 so that the pulleys 101 and 201 may be moved in horizontal direction to tighten the endless flexible means of the lower conveyors 100*b* and 200*b*. The pulley 312 of the third conveyor means 300 is mounted in the same manner for tightening the endless flexible means extending about the lower conveyor 300*b*. The apparatus includes further a guide 42, as shown in FIG. 1, which is mounted in stationary position adjacent the conveyor 100 and the guide 42 has a portion 42' substantially parallel to the conveyor 100 and an upstream lead-in portion 42'' which extends outwardly at an angle from the leading end of the portion 42'. The guide 42 is arranged for engaging the ends of the sheaths as they are transported by the lower conveyors 100*b* and 200*b* to thus align the engaged ends in the direction of the path at which the sheaths are transported.

The endless flexible means 100*a'*, 100*b'*, 200*a'*, 200*b'*, 300*a'* and 300*b'* respectively wound about the pulleys of the upper and lower conveyors of the conveyor means 100, 200 and 300 may be constituted by ropes or by rubber belts provided with ridges and the rims of the pulleys are provided at the peripheral surfaces thereof with grooves in which the ropes or the ridges of the rubber belts are frictionally engaged.

Figure 8:
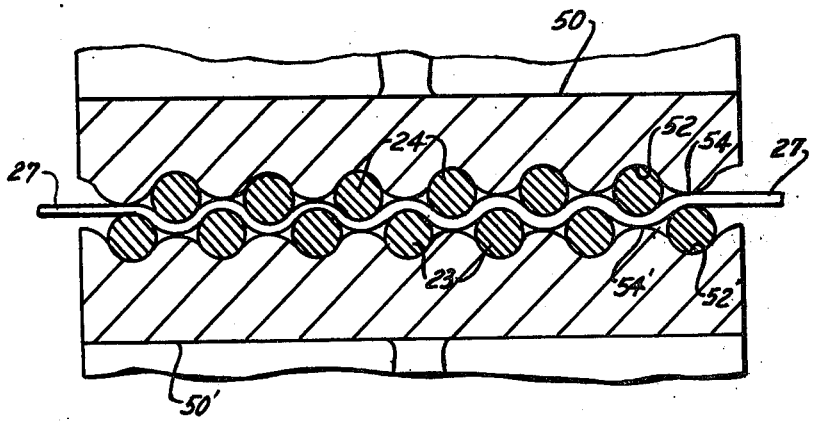
FIG. 8 is a partial cross-section through cooperating pulleys of the upper and lower conveyor of each conveyor means in which the endless flexible means located in the pulleys are formed by ropes.

FIG. 8 illustrates an arrangement in which the endless flexible means mentioned before are constituted by endless ropes wound about the pulleys as described in connection with FIGS. 5A–7B. The rims 50 of the pulleys of all upper conveyors 100*a*, 200*a*, and 300*a*, are formed at the outer peripheral surface thereof with a plurality of grooves 52 of part-circular cross-section which are transversely spaced from each other and separated by convexly curved ridges 54. The rims of the pulleys 50' of the lower conveyors 100*b*, 200*b*, and 300*b*, are formed on the peripheral surface thereof likewise with grooves 52' of the same cross section as the grooves 52 and likewise separated by convexly curved ridges 54' but, as shown in FIG. 8, the grooves 52' are transversely offset with regard to the grooves 52 so that a ridge 54 on the rim of each pulley of each upper conveyor is located opposite a groove 52' in the rim of the pulley of each lower conveyor. The aforementioned endless flexible means are in this case constituted by a plurality of endless ropes 23 and 24 respectively located in the grooves 52' and 52.

When the pulleys of the upper and lower conveyors are in the operative positions thereof as shown in FIG. 8 the sheaths 27 fed between the ropes 23 and 24 will be deformed to the wavy configuration as shown in FIG. 8 so that they will be tightly gripped between the facing portions of the ropes. The grooves 52 and 52' and the ridges 54 and 54' therebetween should be configurated in relation to the diameter of the ropes 23 and 24 so that the ropes, even in the absence of any fibrous material therebetween, will not engage each other but so that the ropes 23 will engage the ridges 54 while the ropes 24 will engage the ridges 54'.

Figure 9:
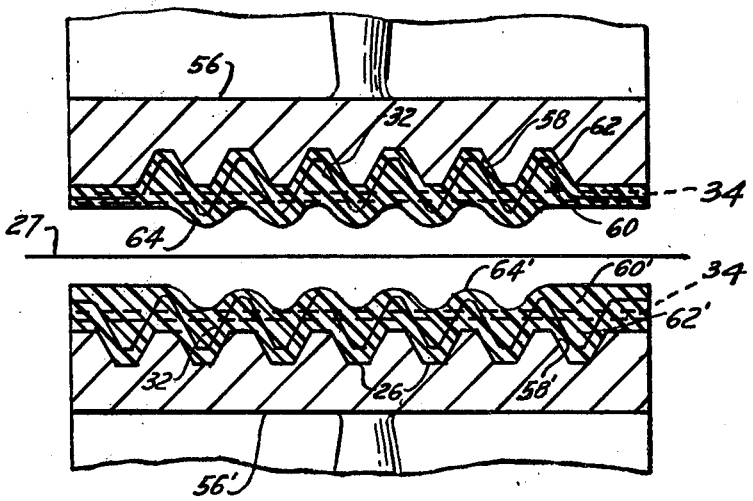
FIG. 9 is a partial axial cross section through a modified pulley construction with modified endless conveyor means located in the grooves thereof, with the two pulleys being shown spaced from each other.
Figure 10:
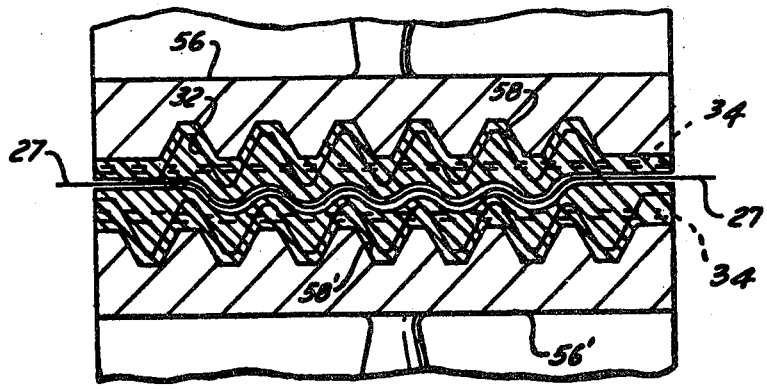
FIG. 10 is a partial cross-section corresponding to FIG. 9 in which the upper pulley is moved toward the lower pulley so that the endless flexible means located in the grooves of the pulleys will engage sheaths of fibrous material to convey the latter.

FIGS. 9 and 10 illustrate an arrangement in which the aforementioned endless flexible means are formed by rubber belts. In this arrangement, the rims 56 of all pulleys of all upper conveyors 100*a*, 200*a*, and 300*a* are provided on the outer peripheral surface thereof with a plurality of grooves 58 of trapezoidal cross section which are transversely spaced from each other and the rims 56' of the pulleys of the lower conveyors 100*b*, 200*b*, and 300*b* are formed with corresponding grooves 58' of the same cross section as the grooves 58, but, as clearly shown in FIGS. 9 and 10, the grooves 58' are offset in transverse direction with regard to the grooves 58 so that each groove 58' faces a ridge between corresponding grooves 58. The endless flexible means in this case are constituted by rubber belts respectively designated with the reference numerals 60 and 60', and each of the rubber belts has a plurality of longitudinally extending transversely spaced ridges 62, respectively 62', of trapezoidal cross section substantially identical to the cross section of the grooves 58 and 58' and respectively located in these grooves. Since the grooves 58 and 58' are offset in transverse direction, the corresponding ridges 62 and 62' on the rubber belts 60 and 60' have also to be correspondingly offset in transverse direction as clearly shown in FIGS. 9 and 10. The surfaces of the two belts 60 and 60' which are opposite to the surfaces from which the ridges 62 and 62' project have an undulated configuration so as to provide a plurality of convexly curved ridges 64, respectively 64', separated by concavely curved grooves, and as clearly evident from FIGS. 9 and 10, the convexly curved ridges 64' on the rubber belt 60' are transversely offset with regard to the ridges 64 on the rubber belt 60. In FIG. 9 the two belts are shown considerably spaced from each other, whereas FIG. 10 shows the belts in operative position, and as evident from this Figure the sheaths 27 transported by the belts will be deformed into a wavy configuration, as shown in FIG. 10, so that these sheaths 27 will be tightly gripped by the two rubber belts. The rubber belts are preferably reinforced and such reinforcement may include for each belt a transverse web 34 and a zig-zag web 32 embedded in the material of the respective rubber belt.

While the arrangement shown in FIG. 8 is simpler in construction than the arrangement as shown in FIGS. 9 and 10, the latter arrangement provides not only a better frictional engagement between the pulleys and the rubber belts, but a scheme more in line with modern trends of machine design conducive to lower cost of manufacture and greater simplicity of maintenance.

Figure 11:
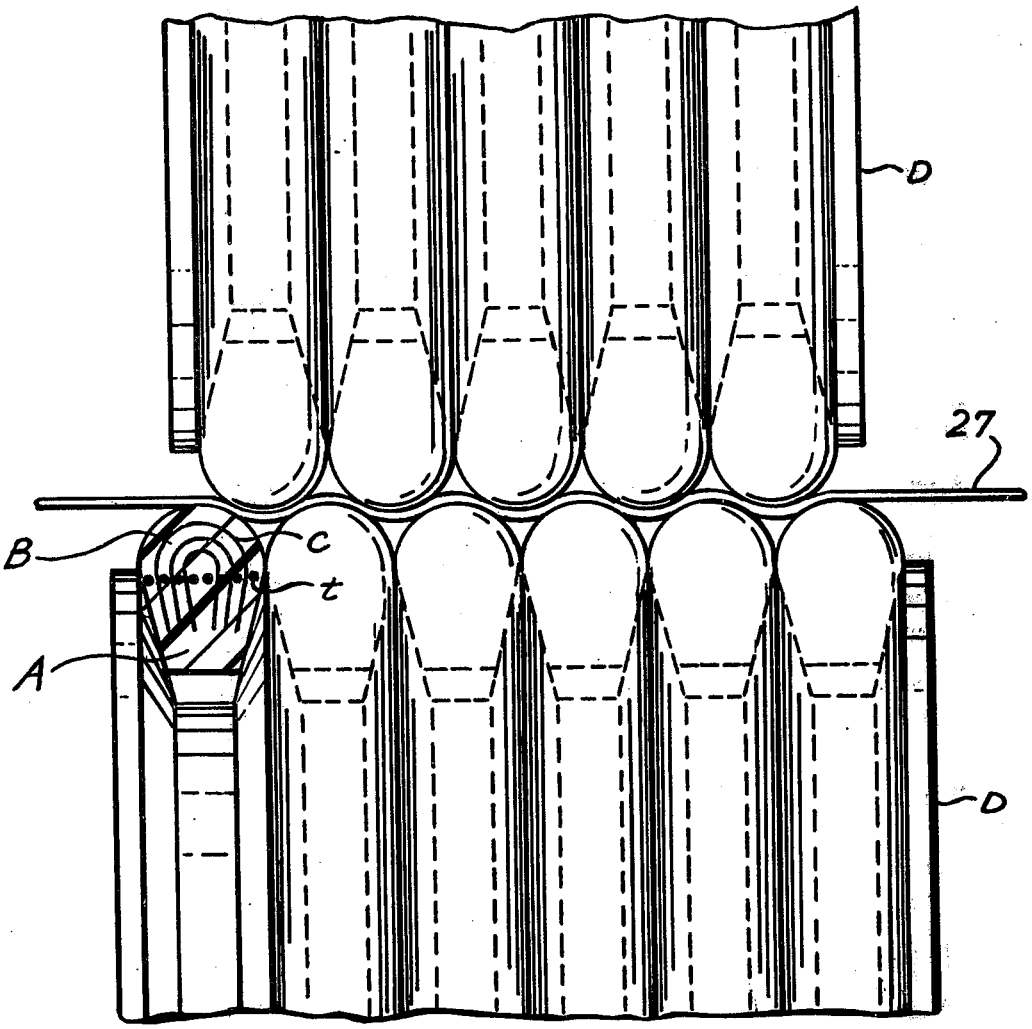
FIG. 11 depicts another pulley and belt construction which can be used in the apparatus of the invention.

FIG. 11 depicts a belt construction constituting an alternative to those shown in FIGS. 8, 9 and 10. A plurality of belts are employed side-by-side, each belt being of the so-called V-belt type. Each belt has a section A of trapezoidal cross-section which is received in the corresponding trapezoidal grooves in the guide pulleys or rollers. In addition, each belt has a crown section B of convex cross-sectional configuration. The guide grooves in the guide pulleys or roller are so offset that the convex crown portions B of the belts fit into each other--i.e., the upper portions of the crown portions of the lower belts in FIG. 11 are located higher than the lower portions of the crown portions of the upper belts in FIG. 11, with the crown portions of the lower belts projecting into the spaces defined between two adjoining crown portions of the upper belts, and vice versa. The belts which are advantageously made of elastomeric (rubber or a synthetic plastic) material are provided with reinforcing fibers t and with reinforcing fibers c. These reinforcing fibers serve to hold the mass of rubber or synthetic plastic material together despite the stresses and deformation to which the belts are subjected.

The above described apparatus will operate as follows:

The sheaths of fibrous material, for instance sheaths of Abaca, are fed by hand or by an additional conveyor, not shown in the drawing, sidewise one after the other onto the portions of the endless flexible means 100*b'* and 200*b'* respectively extending between the pulleys 101 and 102 and 201 and 202, so as to be fed between the lower runs of the upper conveyors 100*a* and 200*a*, and the upper runs of the lower conveyors 100*b* and 200*b* while the upper ends of the sheaths, as viewed in FIG. 1, are aligned with each other by the guide means 42. The sheaths are then tightly gripped and transported towards the first stripping means $S_1$. During the first part of the movement of the sheaths over the stripping means $S_1$, the sheaths are gripped at transversely spaced portions thereof by the conveyor means 100 and 200, and as soon as the sheaths reach the trailing end 100" of the first conveyor they are gripped at portions thereof by the third conveyor 300 so that they are still gripped at transversely spaced portions by the conveyor means 200 and 300 at the beginning of their passage over the second stripping means $S_2$. Only after the sheaths reach the trailing end 200" of the second conveyor means they are only gripped between the lower run of the upper conveyor 300*a* and the upper run of the lower conveyor 300*b* which pull the thus gripped sheaths over the outwardly extending portion $S_2''$ of the second stripping means. As mentioned before, each of the stripping means comprises a blade having an upper stripping edge against which the sheaths are pressed by a wooden block or the like so that the pulpy material is squeezed out together with the sap of the sheaths while they are transported sidewise by the conveyor means.

It will be understood that each of the elements described above, or two or more together, may also find a useful application in other types of apparatus for defibering sheaths of fibrous material differing from the types described above.

While the invention has been illustrated and described as embodied in a novel apparatus for defibering sheaths of fibrous material in which the sheaths are transported sidewise by conveyor means over stripping blades, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A conveyor arrangement, comprising, in combination, a first series of at least three parallel elongated guide rollers having respective first rotation axes, neighboring ones of the guide rollers being spaced apart to define first elongated inter-roller spaces which extend parallel to the first rotation axes; a second series of at least three parallel elongated guide rollers having respective second rotation axes, neighboring ones of the guide rollers of the second series being spaced apart to define second elongated inter-roller spaces which extend parallel to the second rotation axes, the guide rollers of the first series projecting towards and extending into respective ones of the second elongated inter-roller spaces, the guide rollers of the second series projecting towards and extending into respective ones of the first elongated inter-roller spaces; a first endless conveyor arrangement comprising first elongated endless conveyor means encircling the first series of guide rollers and having a first run which is supported on the surfaces of the first series of guide rollers, the first run extending between the first series of guide rollers and the second series of guide rollers, so that the first series of guide rollers is located to one side of the first run whereas the second series of guide rollers is located to the opposite side of the first run; a second endless conveyor arrangement comprising second elongated endless conveyor means encircling the second series of guide rollers and having a second run which is supported on the surfaces of the second series of guide rollers, the second run extending between the first series of guide rollers and the second series of guide rollers, so that the second series of guide rollers is located to one side of the second run whereas the first series of guide rollers is located to the opposite side of the second run, the second run adjoining the first run and defining together with the first run an elongated path for fibrous material to be transported and gripped between said first and second runs, said first elongated endless conveyor means being comprised of a plurality of parallel endless first elongated conveyor sections arranged side-by-side in the direction transverse to the elongation of said first sections to define a plurality of elongated parallel first intermediate spaces extending along substantially the entire length of said first run, and said second elongated endless conveyor means being comprised of a plurality of parallel endless second elongated conveyor sections arranged side-by-side in the direction transverse to the elongation of said second sections to define a plurality of elongated parallel second intermediate spaces extending along substantially the entire length of said second run, and wherein along substantially the entire lengths of said first and second runs said sections of said conveyor means project in the direction from the respective one of said runs towards the other one of said runs into respective ones of the plurality of elongated parallel intermediate spaces of the other one of said conveyor means, wherein said first elongated endless conveyor means is comprised of a respective first plurality of parallel spaced discrete endless conveyor members each constituting one of said first sections, and wherein said second elongated endless conveyor means is comprised of a respective second plurality of parallel spaced discrete elongated endless conveyor members each constituting one of said second sections.

2. A conveyor arrangement as defined in claim 1, wherein the guide rollers of the first series are each provided with a plurality of axially spaced receiving recesses, each of said first conveyor members being received in a respective one of the receiving recesses of each of the guide rollers of the first series, and wherein the guide rollers of the second series are each provided with a plurality of axially spaced receiving recesses, each of said second conveyor members being received in a respective one of the receiving recesses of each of the guide rollers of the second series.

3. A conveyor arrangement as defined in claim 1, and including first stationary support means mounting the guide rollers of the first series for rotation about their axes, second support means movable towards and away from the stationary support means and mounting the guide rollers of the second series for rotation about their axes, and biasing means biasing said movable support means towards said stationary support means.

4. A conveyor arrangement as defined in claim 2, wherein each receiving recess in said guide rollers has a cross-section forming part of a circle, said receiving recesses being separated by ridges each having a cross-section of a convex circular sector and wherein said parallel spaced discrete elongated endless conveyor members are located in said receiving recesses and have a circular cross-section.

5. A conveyor arrangement as defined in claim 4, wherein said endless conveyor members are constituted by ropes.

6. A conveyor arrangement as defined in claim 2, wherein the receiving recesses on each guide roller are spaced from each other by a predetermined distance and wherein the receiving recesses of said first series are axially offset relative to the receiving recesses of said second series by one half said predetermined distance.

7. A conveyor arrangement as defined in claim 2, wherein said receiving recesses are of a trapezoidal cross-sectional configuration, and wherein said endless conveyor members are each comprised of a base portion of complementary trapezoidal cross-sectional configuration.

8. A conveyor arrangement as defined in claim 7, wherein said endless conveyor members are each further comprised of crown portions of convex generally circular cross-sectional configuration.

9. A conveyor arrangement as defined in claim 8, wherein said endless conveyor members are made of elastomeric material and are provided with reinforcing fibers running both parallel to the elongation of said endless conveyor members and transversely thereto parallel to the surfaces of the crown portions thereof.

10. A conveyor arrangement as defined in claim 1, the rotation axes of the first series of guide rollers together defining a first common plane, the rotation axes of the second series of guide rollers together defining a second common plane, the second common plane being parallel to but spaced from the first common plane, all the guide rollers of the first and second series having the same diameter, the rotation axes of successive guide rollers of the first series being spaced one from the next a distance less than twice said diameter, the rotation axes of successive guide rollers of the second series being spaced one from the next a distance less than twice said diameter.

* * * * *